US009328523B2

(12) United States Patent
Ferraiolo

(10) Patent No.: US 9,328,523 B2
(45) Date of Patent: May 3, 2016

(54) MOULD FOR THE CONSTRUCTION OF A PROTECTION AND SECURING ELEMENT OF THE MATTRESS TYPE AND RELEVANT METHOD

(75) Inventor: Francesco Ferraiolo, Bologna (IT)

(73) Assignee: OFFICINE MACCAFERRI S.P.A., Zola Predosa (BO) (IT)

( * ) Notice: Subject to any disclaimer, the term of this patent is extended or adjusted under 35 U.S.C. 154(b) by 513 days.

(21) Appl. No.: 13/702,249

(22) PCT Filed: Jun. 16, 2011

(86) PCT No.: PCT/IB2011/052634

§ 371 (c)(1),
(2), (4) Date: Dec. 5, 2012

(87) PCT Pub. No.: WO2011/158209

PCT Pub. Date: Dec. 22, 2011

(65) Prior Publication Data

US 2013/0075574 A1 Mar. 28, 2013

(30) Foreign Application Priority Data

Jun. 18, 2010 (IT) ..... BO2010A0397

(51) Int. Cl.
*E04G 9/00* (2006.01)
*B28B 7/26* (2006.01)
*B28B 23/00* (2006.01)

(52) U.S. Cl.
CPC ... *E04G 9/00* (2013.01); *B28B 7/26* (2013.01); *B28B 23/0012* (2013.01)

(58) Field of Classification Search
CPC .. B28B 7/241; B28B 23/0012; B28B 23/026; B28B 7/26; E04G 9/00
USPC ..... 249/64, 69–71, 90, 119, 120, 126, 129, 249/132; 425/117, 121, 125; 264/333; 211/71.01, 88.01, 126.3, 182, 207
See application file for complete search history.

(56) References Cited

U.S. PATENT DOCUMENTS 1,448,884 A * 3/1923 Walker ..... 425/431
2,019,877 A * 11/1935 Thomas ..... 141/246

(Continued)

FOREIGN PATENT DOCUMENTS

DE 102010016444 A1 * 10/2011
EP 1 557 248 A1 7/2005

(Continued)

OTHER PUBLICATIONS

Form PCT/ISA/220 mailed Oct. 21, 2011 (1 page).

(Continued)

*Primary Examiner* — Yogendra Gupta
*Assistant Examiner* — Emmanuel S Luk
(74) *Attorney, Agent, or Firm* — Flynn, Thiel, Boutell & Tanis, P.C.

(57) ABSTRACT

A mould for constructing a protection and securing element of the mattress type comprises an upper frame (10), a lower frame (30) and a plurality of dies engaged in the lower frame and particularly suitable during use for receiving cement material. The upper and lower frames are modular structures which each comprise a plurality of carrier elements which are selectively connected to each other, the number and/or length of the carrier elements being variable, during use, so as to vary the length and/or the width of the mould.

10 Claims, 6 Drawing Sheets

(56) References Cited

U.S. PATENT DOCUMENTS

| | | | | | |
|---|---|---|---|---|---|
| 2,389,317 | A | * | 11/1945 | Kitto | 62/73 |
| 2,595,599 | A | * | 5/1952 | Naillon | 211/207 |
| 2,619,047 | A | * | 11/1952 | Henderson | 249/92 |
| 3,310,276 | A | * | 3/1967 | Bonney | 249/120 |
| 3,478,998 | A | * | 11/1969 | Burford | 249/120 |
| 3,661,353 | A | * | 5/1972 | Newsteder | 249/103 |
| 4,627,764 | A | * | 12/1986 | Scheiwiller | 404/41 |
| 5,032,340 | A | * | 7/1991 | Akihama et al. | 264/258 |
| 2005/0061947 | A1 | * | 3/2005 | Smirnov et al. | 249/140 |
| 2008/0042316 | A1 | | 2/2008 | Geiger | |
| 2011/0253658 | A1 | * | 10/2011 | Jarvis et al. | 211/134 |

FOREIGN PATENT DOCUMENTS

| | | | | | |
|---|---|---|---|---|---|
| GB | 2097712 | A | * | 11/1982 | B28B 7/02 |
| GB | 2 348 230 | A | | 9/2000 | |
| JP | 60023029 | A | * | 2/1985 | B29C 67/22 |
| JP | 02106674 | A | * | 4/1990 | F25C 1/24 |
| JP | 2-308061 | | | 12/1990 | |
| JP | 06226725 | A | * | 8/1994 | B28B 7/34 |
| WO | WO 01/88277 | A1 | | 11/2001 | |

OTHER PUBLICATIONS

Form PCT/ISA/210 mailed Oct. 21, 2011 (4 pages).
Form PCT/ISA/237 mailed Oct. 21, 2011 (6 pages).
Response dated Apr. 18, 2012 responding to the Written Opinion issued on Oct. 21, 2011 in Application No. PCT/IB2011/052634 (2 pages).
Response dated Aug. 22, 2012 responding to the Written Opinion issued on Jul. 4, 2012 in Application No. PCT/IB2011/052634 (1 page).
Form PCT/IPEA/416 mailed Sep. 7, 2012 (1 page).
Form PCT/IPEA/409 mailed Sep. 7, 2012 (5 pages).

* cited by examiner

MOULD FOR THE CONSTRUCTION OF A PROTECTION AND SECURING ELEMENT OF THE MATTRESS TYPE AND RELEVANT METHOD

The present invention relates to the field of elements for protecting and securing underwater structures.

The invention has been developed with particular regard to a mould for constructing a protection and securing element of the mattress type, comprising a plurality of blocks of cement material which are connected to each other by means of cables, ropes or the like.

There are known different embodiments of mattresses of cement material, preferably concrete, comprising a plurality of blocks, for example, of cuboid or parallelepipedal shape, which are arranged in parallel rows and connected to each other, longitudinally and transversely, by means of ropes of plastics material, for example, cables of polypropylene. One of the main characteristics for which those mattresses are found to be advantageous is the flexibility thereof and the ease of adaptability to the surface on which they are set down. There are a large number of embodiments, in the prior art, of mattresses of the above-mentioned type with blocks of concrete having different shapes such as, for example, those illustrated in the documents WO 0188277 and GB 2348230.

Those concrete mattresses are generally constructed using specific moulds, or forms or dies, of metal. The moulds of known type are constituted by a lower frame and an upper frame, both of substantially rectangular shape with four peripheral sides, and having an internal grid-like structure. Dies for the concrete are inserted into the apertures defined by that grid. During use, the lower frame is first provided and the dies are inserted into the apertures of the grid. Subsequently, cables which are arranged in accordance with longitudinal and transverse directions with respect to the sides of the frame are suspended above the dies. The upper frame is then positioned above the lower frame so as to fix the cables in position and the two frames are connected to each other. Subsequently, the dies are filled with sufficient concrete to submerge the cables which are thereby surrounded with concrete which sets. Once the concrete has set, the upper frame is removed and the blocks are withdrawn from the dies using the connection cables, obtaining the protection and securing element of the mattress type mentioned above.

One of the main disadvantages of the moulds of the known type is that the mattresses which can be constructed with a specific mould are predetermined in terms of the dimensions of the concrete blocks, the mutual spacing between the blocks, the number of blocks which constitute the mattress and, therefore, the peripheral dimension thereof. Since the mutual spacing along the longitudinal rows and/or the mutual spacing between the longitudinal rows of blocks must be adapted to the specific site of use, until today it has been necessary to provide a specific and particular mould for each type of structure to be secured and application to be carried out.

Another disadvantage of the moulds of known type is constituted by the great spatial requirement of the upper frame and lower frame, which makes the operations for transport from the factory to the building site complex, and the weight thereof, which makes the operations for movement and installation at the construction location of the mattress difficult.

An object of the present invention is to overcome the disadvantages of the prior art by providing a mould for constructing a protection and securing element of the mattress type which is sectional, modular and modifiable, so that, with a single mould, it is possible to construct mattresses from concrete having different dimensions, with a different number of blocks, with longitudinal and transverse spacings which are variable between the blocks, and with concrete blocks of different dimensions and shapes.

Another object of the present invention is to provide a mould for constructing a protection and securing element of the mattress type which is readily transportable, light and easy to move and/or install in situ.

In order to achieve the above-described objects, the present invention relates to a mould for constructing a protection and securing element of the mattress type as defined in the appended claims.

One of the advantageous features of the present invention involves the fact that the upper frame and lower frame, by which the mould is constituted, are modular structures which each comprise a plurality of carrier elements which are connected to each other selectively, the number and/or the length of the carrier elements being variable during use so as to be able to modify the arrangement of the dies inside the frames and, therefore, the arrangement of the concrete blocks in the mattress.

According to one of the preferred embodiments of the present invention, each frame comprises a plurality of carrier elements arranged in parallel rows in a longitudinal direction and a plurality of carrier elements arranged in parallel rows in a transverse direction so as to bring about a grid-like configuration, the carrier elements being engaged with each other by joint means.

Other features and advantages will be appreciated from the following detailed description of a preferred embodiment of the invention, with reference to the appended drawings which are given purely by way of non-limiting example and in which.

Figure 1:
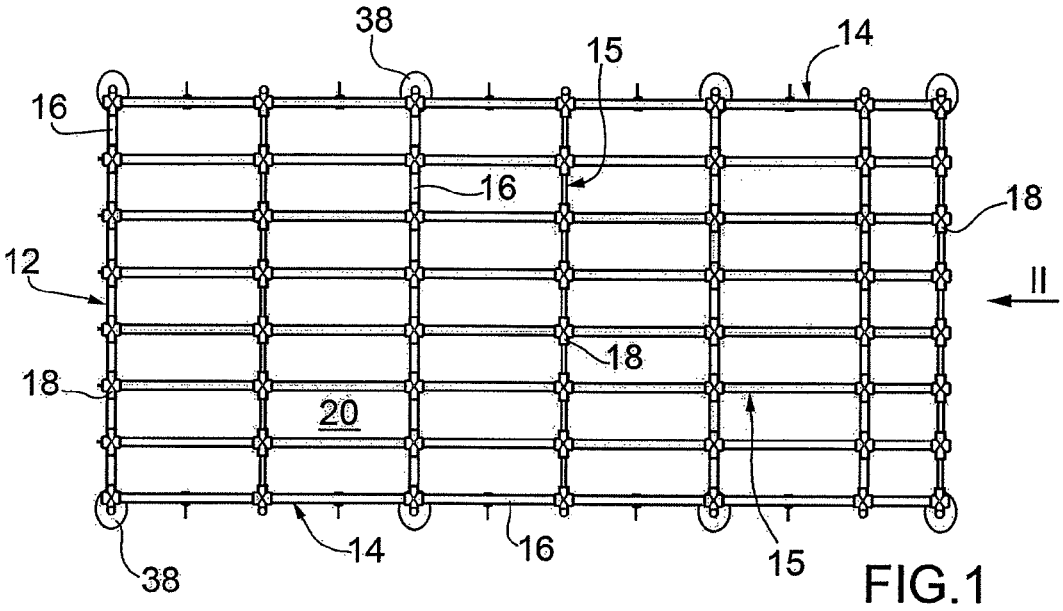
FIG. 1 is a top view of a first embodiment of a mould for constructing a protection element of the mattress type according to the present invention.

With reference to FIGS. 1 to 14, a first embodiment of a mould for constructing a protection and securing element of the mattress type according to the present invention generally comprises a structure to which various dies are connected.

The structure comprises two or more frames, each of which is formed by a plurality of carrier elements which are connected to each other in order to construct a modular type structure. A first group of carrier elements is provided in a parallel row in a longitudinal direction and a second group of carrier elements is provided in a parallel row according to a transverse direction relative to the direction of the first group of carrier elements, so as to construct a substantially grid-like configuration.

The carrier elements are engaged with each other by means of joints. In particular, the structure comprises an upper frame 10 and a lower frame 30 which can be connected to each other using connection means. Each frame 10, 30, which is rectangular in a preferable but non-limiting manner, comprises four peripheral carrier elements 12, 14 which are connected to each other at the ends and a plurality of internal carrier elements 15 which are provided transversely relative to the peripheral carrier elements 12, 14 in such a manner as to define a grid-like frame having a plurality of apertures 20. The internal carrier elements 15 are selectively connected to the peripheral carrier elements 12, 14 by means of joint members so as to be able to vary, during use, the number and/or position thereof inside the grid-like frame and, consequently, to modify the dimensions and the arrangement of the apertures 20.

According to a particularly advantageous embodiment of the present invention, each peripheral and/or transverse carrier element comprises one or more steel tubes 16 which are connected to each other by means of joint members, for example, cast iron joints 18. Each joint 18 comprises a main member and a plurality of apertures in which, during use, ends of the tubes 16 are inserted. The joints can have a "T"-like, "L"-like or cruciform formation according to the position thereof inside the frame and, therefore, according to the number of tubes 16 engaged therewith. In the example illustrated in FIG. 1, the frame comprises "L"-like joints which are arranged at the four corners of the frame, "T"-like joints which join the tubes 16 in order to form the peripheral carrier elements of the frame 12, 14 and a plurality of cruciform joints inside the frame which join the tubes 16 together in order to form the transverse carrier elements 15 which are internal with respect to the frame. In that manner, each frame is a modular structure comprising a plurality of carrier elements which are selectively connected to each other, the number and/or length of the carrier elements being variable during use so as to modify the number and/or arrangement of the apertures inside the grid-like frame and, therefore, the arrangement of the concrete blocks in the mattress.

Naturally, the number and/or dimensions of the tubes could vary widely from those set out, as could the dimensions and shape of the apertures inside the grid. For example, it is possible to further add tubes along the peripheral carrier elements 12, 14 of the frame so as to increase the overall surface thereof, or it is possible to reduce the number of transverse tubes in order to increase the dimensions of the apertures 20 defined by the grid. Similarly, it is possible also to use cruciform joints at the corners or in the peripheral carrier elements in order to allow rapid addition of other tubes. A person skilled in the art will readily be able to individually configure each possible configuration of the grid-like frame which can be obtained with the elements described above without thereby exceeding the scope of the present invention.

Figure 2:
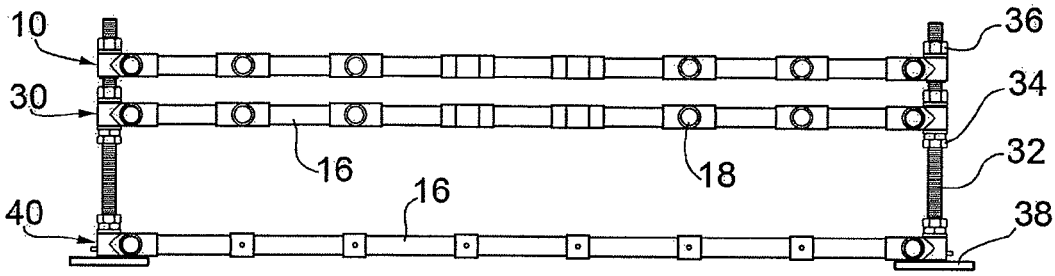
FIG. 2 is a side view of part of the mould according to the arrow II of FIG. 1.
Figure 3:
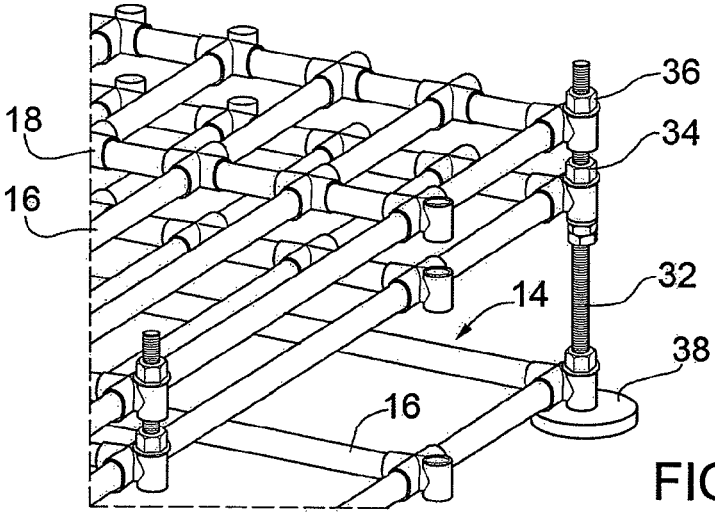
FIG. 3 is a perspective view of an angular portion of the mould illustrated in FIG. 1.

As better illustrated in FIGS. 2 and 3, the structure further comprises means for supporting the lower frame and the upper frame, the ends of the peripheral carrier elements 12, 14 being selectively engaged with the support means. The support means comprise, for example, but in a non-limiting manner, four poles which are arranged at the four vertices of the frames, each of which comprises a vertical bar 32, preferably a bar having a threaded outer surface, with which there is engaged a corner type joint 18 for the lower frame 30 and a corner type joint 18 for the upper frame 10, preferably but in a non-limiting manner an "L"-like joint. The joints of the lower frame 30 are fixed to each pole by way of selective fixing means, for example, a pair of nuts 34 which can selectively be tightened with respect to the threaded surface of the vertical bar 32 of the pole above and below the corner type joint 18. This type of selective fixing allows adjustment during use of the height of the frames, and in particular the lower frame 30, with respect to the ground. The joints 18 of the upper frame are inserted on the vertical bar 32 of the pole and comprise in a higher portion similar fixing means, for example, a nut 36 which can be tightened selectively so as to prevent the upper frame 36 from becoming unscrewed from the vertical bar 32. The poles further comprise a base, for example, a disc 38 of plastics material which is fixed to the lower portion of the vertical bar 32 in order to facilitate the adhesion of the pole to the ground and to improve the overall stability of the structural means of the mould of the present invention. The ends of the peripheral carrier elements 12, 14 are selectively engaged with the poles.

As illustrated in FIG. 1, the mould may also comprise support means 38 along the peripheral carrier elements and/or the internal carrier elements which constitute the grid, on the basis of the dimensions of the frames and therefore the concrete mattress to be constructed.

The structure of the mould of the present invention further comprises a rectangular base frame 40 which comprises four peripheral carrier elements 12, 14 which are connected at the ends to the poles and a plurality of internal carrier elements 15 which are arranged transversely with respect to the peripheral carrier elements. The internal carrier elements 15 are selectively connected to the peripheral carrier elements so as to be able to vary, during use, the position thereof inside the base frame. In this instance, according to a preferred embodiment of the present invention, each peripheral and/or transverse carrier element also comprises one or more steel tubes 16 which are connected to each other by means of the above-described joints 18. As illustrated more clearly in FIGS. 2 and 3, the tubes 16 which constitute the peripheral carrier elements are connected to the poles by means of a corner type joint 18 which in turn is engaged with the threaded vertical bar 32 of the pole and is fixed in position thereon, in a higher portion, by fixing means, for example, a selectively tightenable nut and, in a lower portion, by the base 38.

Figure 5:
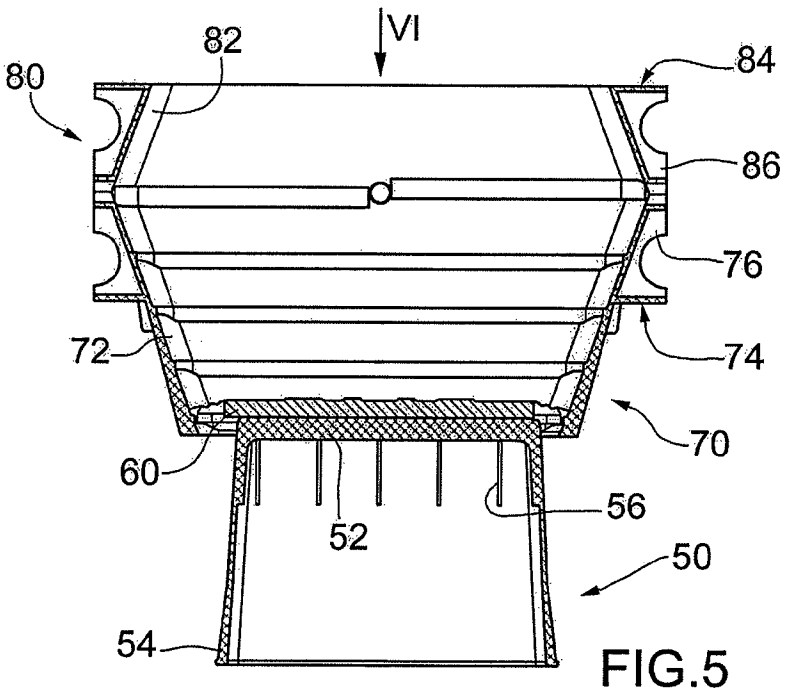
FIG. 5 is a longitudinal section according to line V-V of FIG. 4.
Figure 4:
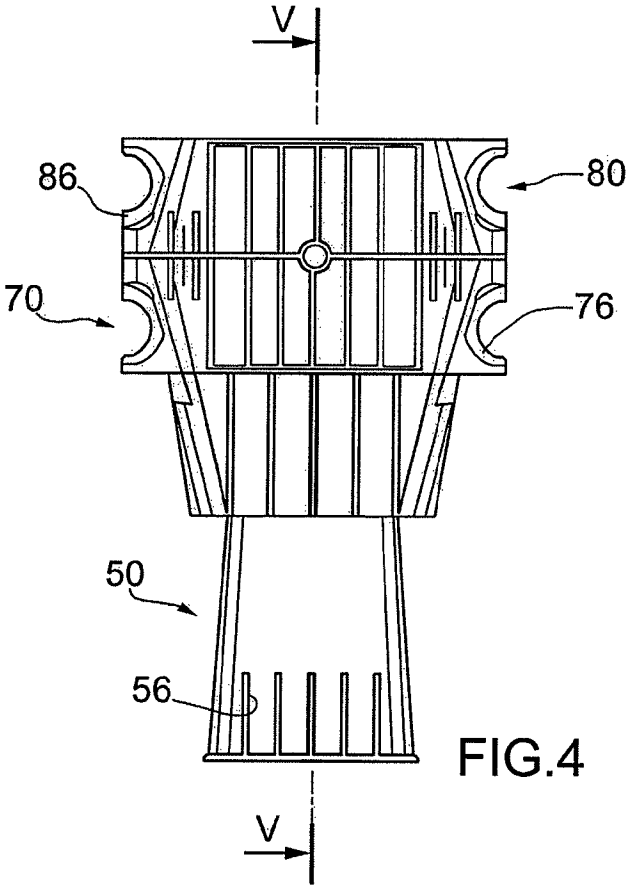
FIG. 4 is a side view of the die means according to the present invention.

A mould for constructing a protection and securing element of the mattress type according to the present invention further comprises a plurality of dies engaged with the above-described structural means. The dies are constructed, in a preferable though non-limiting manner, from a thermoplastic material by means of injection moulding and serve during use to obtain the blocks of cement material of the mattress according to the present invention. As illustrated in FIGS. 4 and 5, each die comprises a die support 50, a die base 60, a lower die member 70 and an upper die member 80.

Figure 7:
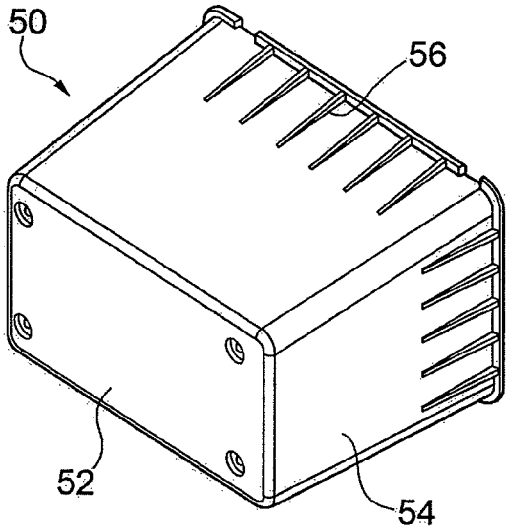
FIG. 7 is a perspective view of a die support of the die means according to the present invention.

With particular reference to FIG. 7, the die support comprises a container 50 substantially in the form of a truncated pyramid having a rectangular base, in which the upper base comprises a base wall 52, and the side walls 54 in the region of the lower base comprise on the outer surface thereof a plurality of longitudinal ribs or projections 56, which are particularly suitable for increasing the load resistance of the side walls 54. As will be appreciated more clearly below, the support function of the die is to support and/or help to support during use the die means when they are filled with cement material. Naturally, a person skilled in the art will be able to specify different forms of die supports with respect to the one described and illustrated, for example, of cuboid or parallelepipedal form, of plastics material or metal, hollow or solid internally, provided that they fulfil their support function.

Figure 6:
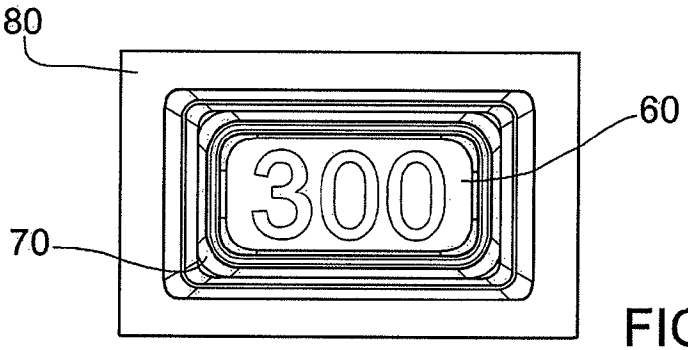
FIG. 6 is a top view of the die means according to arrow VI of FIG. 5.

With reference to FIG. 6, the die base comprises a substantially rectangular plate 60 which is selectively fixed to the base wall 52 of the die support 50. Advantageously, as illustrated in FIG. 5, a number regarding the dimensions, preferably in millimetres, of the die means is impressed in one of the surfaces of the die base such as, for example, the depth of the die means and consequently the height of the concrete block obtained with those die means, or the volume of the concrete block. The number allows rapid identification of the type of die means to be used when the mould is put into operation during the phases of the installation thereof.

Figure 8:
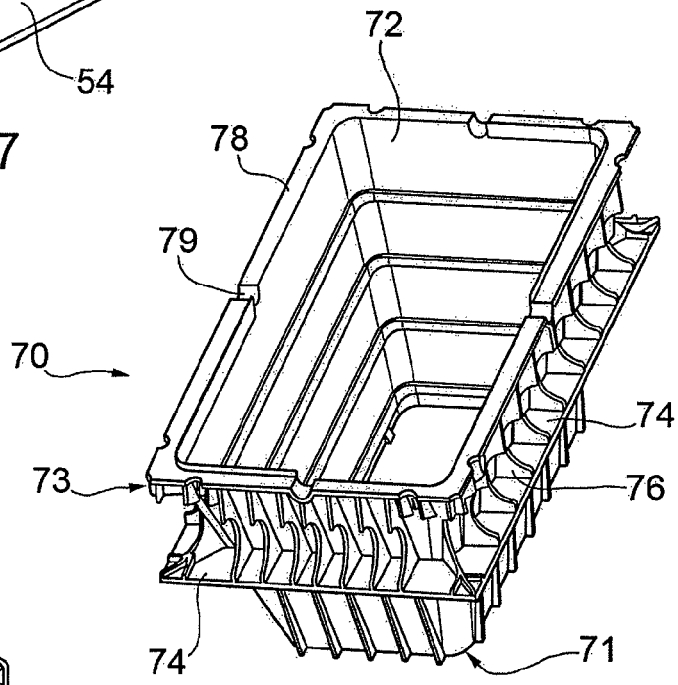
FIG. 8 is a perspective view of a lower die member.
Figure 11:
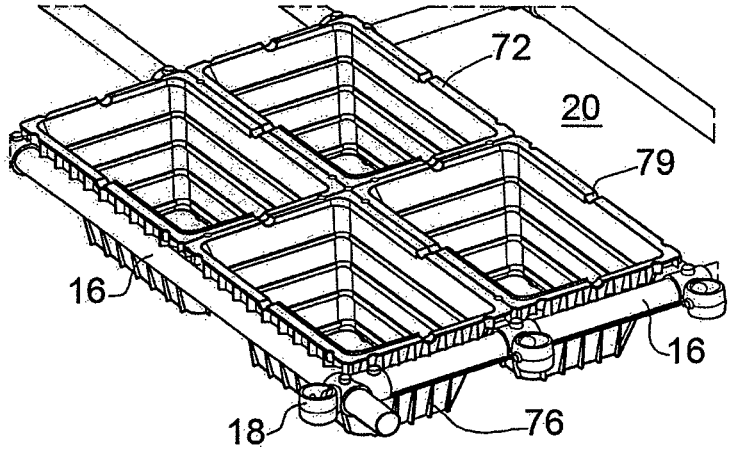
FIG. 11 is a perspective view of part of the lower frame of the first embodiment of the mould, with which the lower die members are engaged.

With reference to FIG. 8, the lower die member 70 is substantially in the form of an inverted truncated pyramid having a rectangular base with four side walls 72, and is arranged during use in such a manner that the smaller base 71 rests on the surface of the die base 60 and the larger base 73 is directed upwards. Over the entire outer peripheral surface of the lower die member 70 there is formed a horizontal fin 74 which is parallel with the planes defined by the smaller base 71 and the larger base 73 of the lower die 70 and which projects outwards, the horizontal fin 74 occupying a central position along the side walls 72 of the lower die member 70. Still with regard to the outer peripheral surface of the lower die member 70 there is formed thereon a plurality of vertical fins 76 which have at one side a right-angled profile and, at the other side, a semicircular recess. The vertical fins 76 are arranged in alignment over the upper portion of the lower die member 70 and press the projecting horizontal fin 74. The vertical fins 76 have a dual function of increasing the load resistance of the side walls 72 of the die member and of producing engagement means, the plurality of semicircular recesses for engagement during use of the lower die member 70 with the tubes 16 of the lower frame 30, as can be seen in FIG. 11. On the surface 78 of the smaller base of the lower die body 70 there are formed engagement means, for example, of the grooves 79 provided at the centre points of the four side walls 72. As will be appreciated more clearly below, there are inserted inside the grooves 79, during use, ropes which connect together in an articulated manner the concrete blocks which constitute the protection and securing element of the mattress type according to the present invention.

Figure 9:
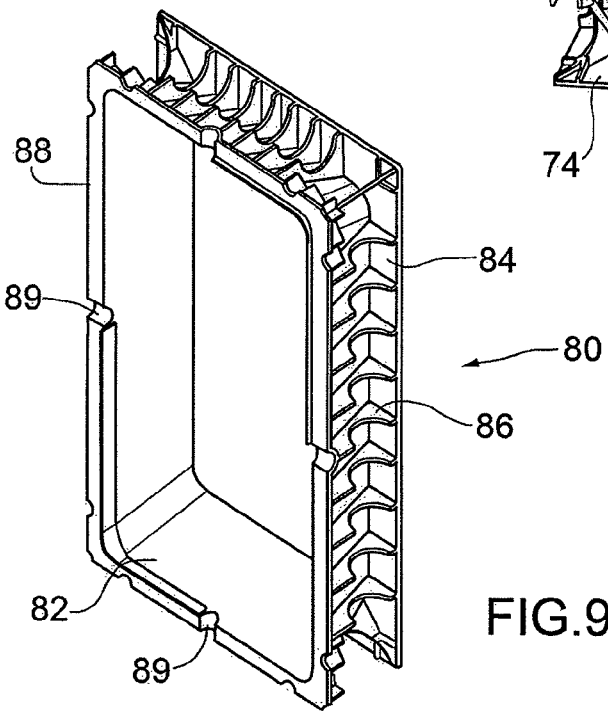
FIG. 9 is a perspective view of an upper die member.
Figure 10:
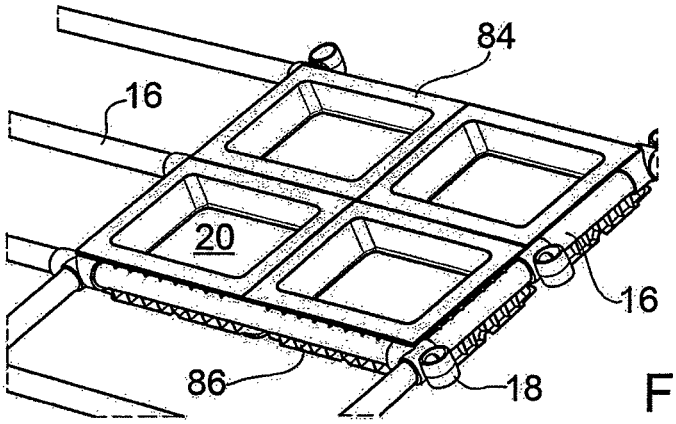
FIG. 10 is a perspective view of part of the upper frame of the first embodiment of the mould, with which the upper die members are engaged.

With reference to FIG. 9, the upper die member 80 is also substantially in the form of a truncated pyramid with a rectangular base with four side walls 82. There is also formed, on the upper die, along the entire outer peripheral surface, a horizontal fin 84 which is parallel with the planes defined by the lower and upper base of the lower die and which projects outwards. The horizontal fin is provided in the region of the outer surface of the smaller base of the upper die member 80. Still with respect to the outer peripheral surface of the upper die member there are formed thereon a plurality of vertical fins 86 which have at one side a right-angled profile and at the other side a semicircular recess. The vertical fins are arranged in alignment and press on the projecting horizontal fin 84. The vertical fins 86 have a dual function of increasing the load resistance of the side walls 82 of the die member and producing engagement means, the plurality of semicircular recesses, for engaging, during use, the upper die member 80 with the tubes of the upper frame 10, as can be seen in FIG. 10. There are formed on the surface 88 of the larger base of the lower die member 80 engagement means, for example, grooves 89 which are arranged at the centre points of the four side walls 82. As will be set out in greater detail below, when the upper die member 80 is positioned during use on the lower die member 70, the grooves 89 contribute to fixing in position the ropes inserted in the grooves 79 of the lower die member 70.

Still with reference to FIGS. 10 and 11, the lower die members 70 and upper die members 80 are fixed to the lower frame 30 and the upper frame 10 of the mould of the present invention, respectively, by engaging the semicircular recesses provided in the side walls 72 and 82 of the die members 70 and 80 with the tubes 16 of the frames 10 and 30, respectively. It is possible to insert two or more die members 70, 80 inside a single aperture 20 of each frame 10, 30 by providing them side by side and engaging up to three of the side walls 72, 82 thereof with the tubes 16, respectively.

Naturally, it is possible to provide different means for engaging the die members with the peripheral and internal carrier elements as well as a large number of different means for combining the die members inside the grid-like frames, for example, one per aperture, simply by modifying the dimensions of the aperture, without thereby exceeding the scope of the present invention. Similarly, the number and/or the length of the carrier elements which can be engaged in the frames is variable so as to be able to modify the length and width of the frames themselves, the arrangement of the apertures of the grids, and therefore the dies inside the frames and, consequently, the arrangement of the concrete blocks in the mattress.

During use, the mould of the present invention is carried in situ in a completely disassembled state. There are provided and transported in situ the peripheral carrier elements 12, 14, the internal carrier elements 15 and the joints 18, of different types, so as to construct a lower frame 30, an upper frame 10 and a base frame 40. Similarly, there are provided and transported in situ a plurality of die means having predetermined dimensions. The number of carrier elements, and therefore the number of steel tubes 16 which constitute them, as well as the number of joints 18 and the number and form of the die means, may vary widely in accordance with the type of protection and securing mattress which is intended to be constructed.

According to a particularly advantageous feature of the present invention, the single elements which constitute the die means are particularly light because they are constructed from thermoplastic material, and can readily be combined one on the other so as to reduce the total spatial requirement and therefore to simplify and facilitate the operations for transporting in situ the mould of the present invention.

Once the above-indicated components have been provided and the technical characteristics of the mattress to be constructed have been selected, for example, height, length, width, number of blocks and mutual arrangement of the blocks, the method for assembling the mould is started. On the basis of the peripheral dimensions of the mattress, a predetermined number of steel tubes 16 are assembled together so as to construct the peripheral carrier elements 12, 14 of the base frame 40 by fixing them to the corner poles. The number of internal carrier elements of the base frame may be selected in accordance with the characteristics of the ground, the gradient thereof and the total weight of the mattress which will be constructed.

Figure 12:
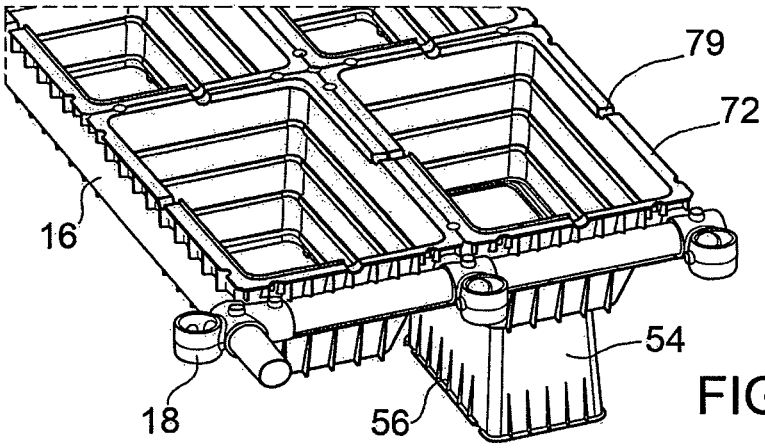
FIG. 12 is a perspective view of part of the lower frame of FIG. 11, with the lower die members and the support elements of the die means.

On the basis of those peripheral dimensions of the mattress, a predetermined number of steel tubes 16 are also assembled with each other so as to construct the peripheral carrier elements 12, 14, for the lower frame 30 and the upper frame 10. On the basis of the number of blocks which will constitute the mattress and the mutual arrangement thereof, the transverse carrier elements 15 are assembled and fixed, by means of the joints 18, to the peripheral carrier elements 12, 14. In the upper frame 10, the upper die members 80 are fixed inside the apertures 20 which are defined by the internal carrier elements 15, inserting the steel tubes 16 inside the plurality of semicircular recesses, as illustrated in FIG. 10. In the lower frame 30, the lower die members 70 are fixed to the interior of the apertures 20 which are defined by the internal carrier elements, inserting the steel tubes 16 inside the plurality of semicircular recesses, as illustrated in FIG. 11. Therefore, the die supports 50 and the die bases 60 are inserted in the lower die members 70, as illustrated in FIG. 12, and the lower frame 30 constructed in that manner is fixed to the vertical bar 32 of the pole by way of fixing means, for example, the pair of nuts 34.

The height of the lower frame 30 with respect to the ground can be selected by modifying the position of the fixing means 34 along the vertical bar 32 of the pole. The height of the lower frame 30 is naturally selected on the basis of the thickness of the mattress which is intended to be obtained and therefore on the basis of the height of the die supports 50 and the lower die member 70 which are engaged inside the mould.

Figure 13:
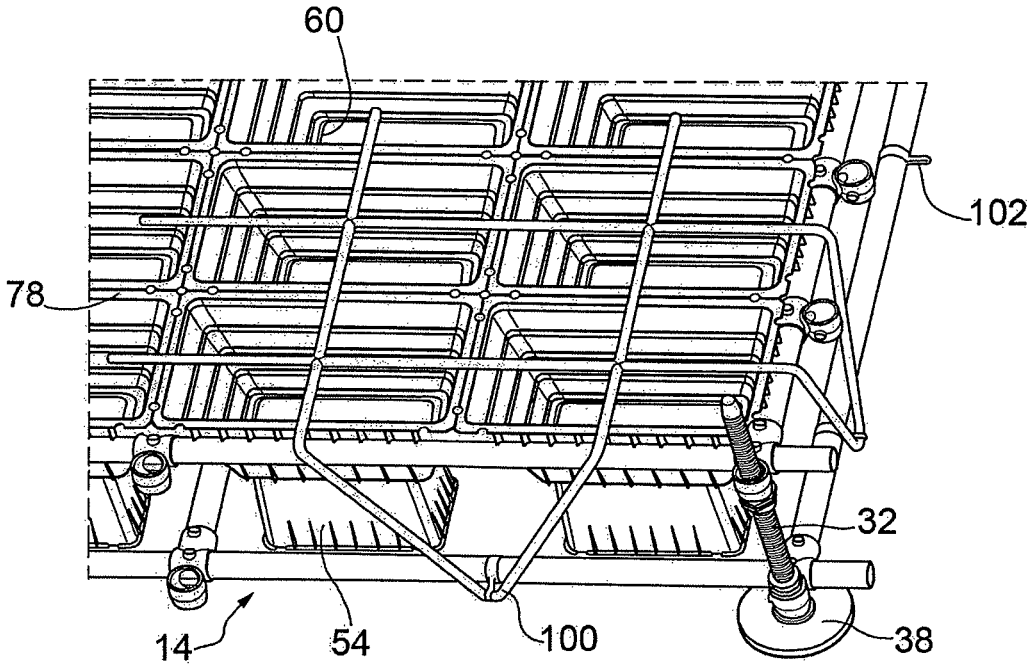
FIGS. 13 and 14 are partial perspective views in two separate installation phases of the first embodiment of the mould according to the present invention.

Once the lower frame 30 has been arranged as described above, a plurality of ropes 100 are suspended thereon by causing them to pass through the grooves 79 of the lower die member, in such a manner that each rope portion 100 extends through the dies at the centre points of the sides thereof, as illustrated in FIG. 13. The ropes 100 are therefore fixed to the peripheral carrier elements 12, 14 by means of spacer gauges 102.

Figure 14:
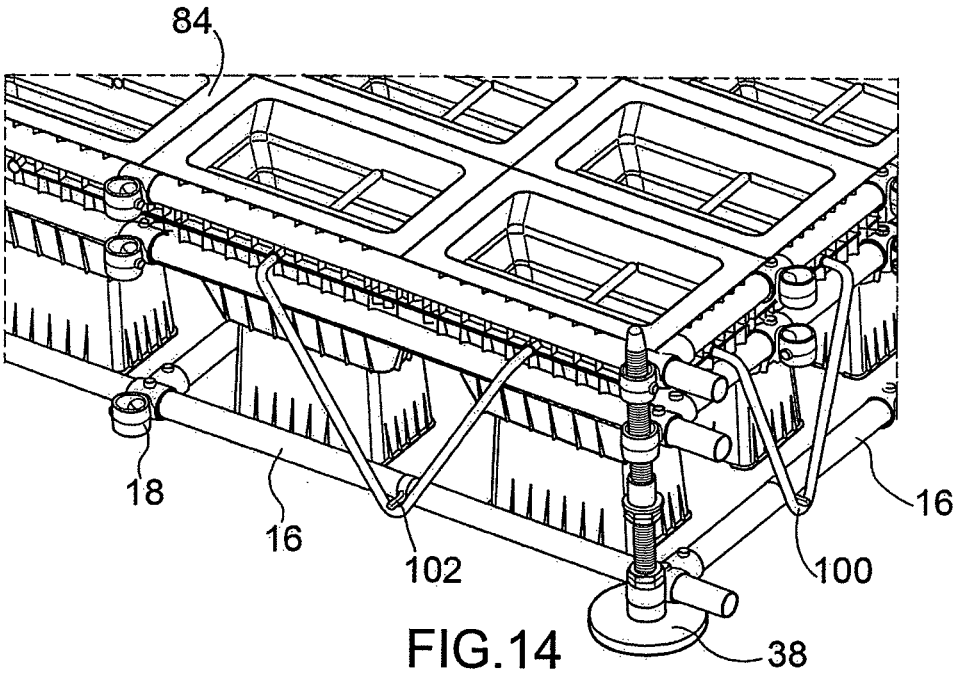

Subsequently, the upper frame 10, assembled beforehand together with the upper die members 80, is positioned above the lower frame 30 and fixed to the vertical bar 32 of the pole by fixing means, for example, the pair of nuts 34, as illustrated in FIG. 14. In that manner, the ropes which also extend in the grooves 89 formed in the surface 88 of the larger base of the lower die members 80 will further be engaged with the mould and secured thereto. The upper frame 10 can therefore be engaged with the lower frame 30 by engagement means.

Subsequently, there is introduced inside each die means the cement material, preferably concrete, for such a quantity as to submerge the ropes 100 but without being discharged from the die members. Once the concrete is matured and hardened, the upper frame 10 is removed and the blocks which are connected to each other by means of the ropes 100 are lifted from the die means, obtaining a protection and securing element of the mattress type which is constituted by a plurality of articulated blocks which are of cement material and which are connected to each other by means of cables.

Figure 15:
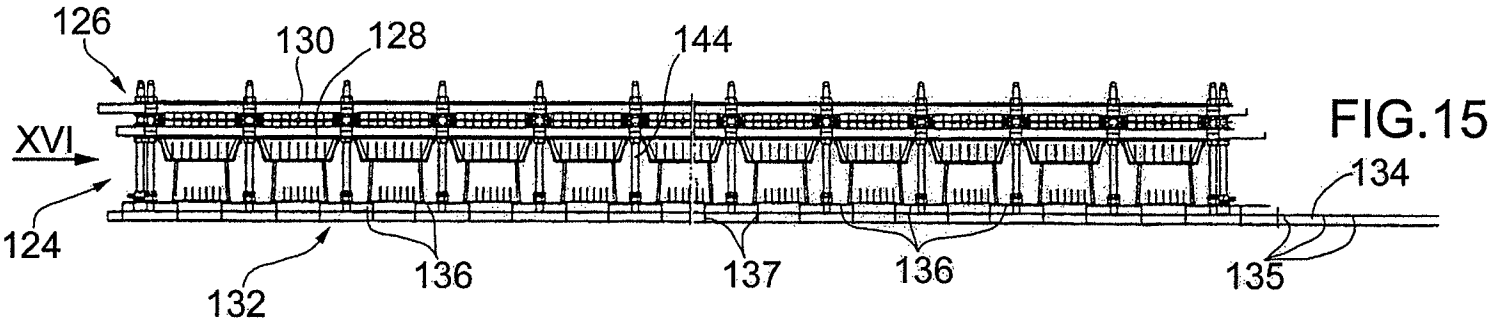
FIG. 15 is a side view of a second embodiment of the mould according to the present invention.
Figure 16:
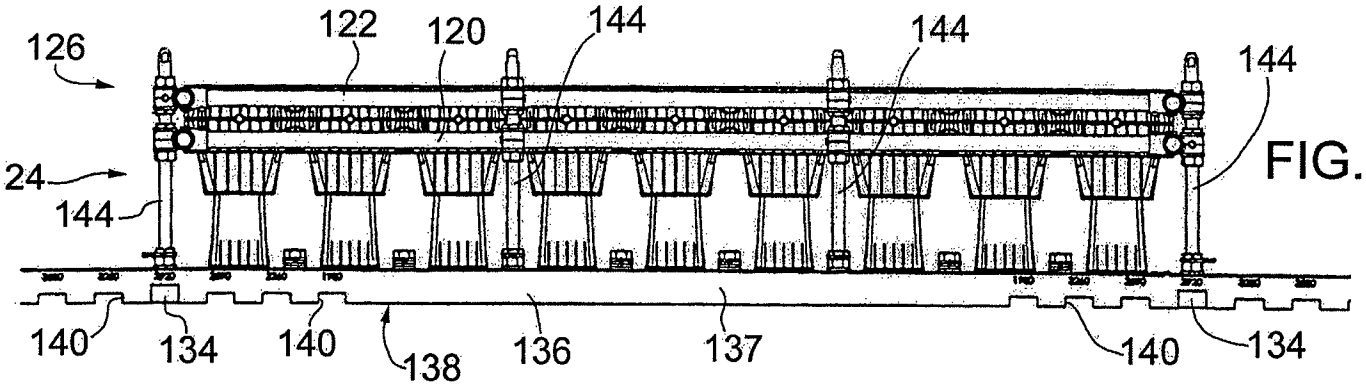
FIG. 16 is a view, drawn to an enlarged scale, according to arrow XVI of FIG. 15.
Figure 17:
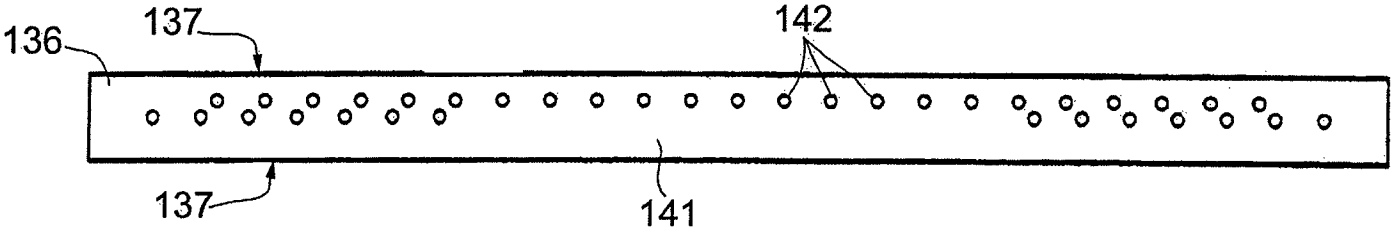
FIG. 17 illustrates a detail of a support cross-member of the mould of FIG. 16.

FIGS. 15 and 16 illustrate another embodiment of the mould according to the present invention. As can be seen, the plurality of dies is supported by a series of transverse bars 120, 122 which support the lower and upper die portions and which form the lower frame 124 and the upper frame 126 and which are joined to longitudinal bars 128, 130, respectively. In the embodiment illustrated in FIGS. 15 and 16, the longitudinal bars are preferably provided only at the lateral ends of the frames in order to reduce the total weight thereof. Naturally, the number of longitudinal bars used could vary from that extreme to the other extreme in which each die is supported at the sides thereof by a pair of bars. The selection of the number of bars in relation to the number of dies depends on the overall dimensions of the mattress to be constructed and the total weight thereof, taking into consideration the possible different capacity of the dies themselves for constructing blocks of cement material having different dimensions and weight.

The lower frame 124 is supported on the ground by means of a support structure 132 which comprises at least two longitudinal beams or members 134 which are preferably constructed by means of long metal bars having rectangular cross-sections and on which there are formed notches 135 at regular distances. Corresponding notches 140 formed at lateral edges 137 of cross-members 136 which are substantially of inverted U-like shape are fitted in the notches 135 of the longitudinal members 134. Holes 142 which have predetermined spacing from each other are formed in the upper face 141 of the cross-members 136. A plurality of uprights 144 for supporting the frames of the mould are introduced and fixed in holes which are selected from the plurality of holes 142 formed in the cross-members 136.

The combination of the spacing between the notches 135 in the longitudinal members 134 and the spacing between the notches 140 and between the holes 142 in the cross-members 136 determines the modularity of the second embodiment of the mould according to the invention. With respect to the first embodiment described above, the support structure constructed by means of the longitudinal members 134 and the cross-members 136 allows any irregularities of the ground on which the mould is supported to be overcome, thereby facilitating the construction thereof in a planar manner.

Though the above description of the preferred embodiments of the present invention has made reference to specific production particulars, construction details and materials and proportions between the various composite portions and elements, there may be provided a number of variants which will be apparent to a person skilled in the art who has appreciated the fundamental properties of the invention from the present description.

Among the possible variants, there should also be included the possibility of constructing dies which are mutually different, in order to construct concrete blocks of different shapes, for example, of a substantially parallelepipedal type at the centre, but having walls which are inclined, chamfered or shaped differently in the region of the edges of the mattress structure.

Naturally, with the principle of the invention remaining the same, the embodiments and construction details may vary widely with respect to those described and illustrated without thereby exceeding the scope of the invention.

The invention claimed is:

1. A mould for constructing a protection and securing element, the mould comprising an upper frame, a lower frame and a plurality of dies engaged in the lower frame and the upper frame, wherein the upper and lower frames are modular structures which each comprise a plurality of carrier elements which are selectively connected to each other, a number and/or length of the carrier elements being selected during use so as to vary a length and/or a width of the mould and an arrangement of the dies engaged with the lower frame and the upper frame, each of the dies comprising at least one die base, a lower die member and an upper die member, the lower die member and upper die member of each of the dies being fixed to the lower frame and the upper frame of the mould, respectively.

2. A mould according to claim 1, wherein the plurality of carrier elements for each of the upper frame and the lower frame are arranged in parallel rows in a longitudinal direction and in parallel rows in a transverse direction so as to construct a grid-like configuration, the carrier elements being engaged with each other by joint members.

3. A mould according to claim 2, wherein each of the upper frame and the lower frame comprises four sides formed by a first set of the plurality of carrier elements which are connected to each other at ends thereof by the joint members and forming a periphery thereof and a second set of the plurality of carrier elements which are arranged transversely and internally with respect to the carrier elements forming the periphery.

4. A mould according to claim 3, wherein each of the carrier elements comprises one or more tubes which are connected to each other by the joint members.

5. A mould according to claim 4, further comprising supports, the joint members of the carrier elements at corners of the periphery being selectively engaged with the supports.

6. A mould according to claim 5, wherein each of the supports comprises a selective fixing element in order to allow adjustment, during use, of a height of each of the lower frame and the upper frame with respect to a ground.

7. A mould according to claim 6, further comprising a base frame comprising at least four peripheral carrier base elements.

8. A mould according to claim 6, further comprising a support structure which comprises at least two longitudinal members, in which there are selectively fitted a plurality of cross-members, to which the supports are connected.

9. A mould according to claim 8, wherein the dies further comprise engagements formed on an outer surface thereof and which are engaged with the plurality of carrier elements.

10. A mould according to claim 1, wherein each of the dies is a unitary structure.

* * * * *